US006206648B1

(12) United States Patent
Kimura et al.

(10) Patent No.: US 6,206,648 B1
(45) Date of Patent: Mar. 27, 2001

(54) COMPRESSOR

(75) Inventors: Kazuya Kimura; Minoru Mera, both of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/219,502

(22) Filed: Dec. 21, 1998

(30) Foreign Application Priority Data

Dec. 24, 1997 (JP) ..... 9-355557

(51) Int. Cl.[7] ..... F04B 1/26
(52) U.S. Cl. ..... 417/222.2; 184/6.17
(58) Field of Search ..... 417/222.2, 269, 417/270; 184/6.17, 26

(56) References Cited

U.S. PATENT DOCUMENTS 3,888,604 * 6/1975 Oshima et al. ..... 417/269
4,963,074 * 10/1990 Sanuki et al. ..... 417/222.2
5,044,892 * 9/1991 Pettitt ..... 417/269
5,181,834 * 1/1993 Ikeda et al. ..... 417/269
5,741,122 * 4/1998 Yokono et al. ..... 417/222.2
5,772,407 * 6/1998 Kato et al. ..... 417/269

* cited by examiner

*Primary Examiner*—Tony M. Argenbright
*Assistant Examiner*—Mahmoud M Gimie
(74) *Attorney, Agent, or Firm*—Morgan & Finnegan, L.L.P.

(57) ABSTRACT

A compressor having a crank chamber in which a large amount of lubricating oil is constantly maintained. The compressor includes a pressurizing passage through which refrigerant gas flows from a discharge chamber to the crank chamber. A displacement control valve varies the displacement of the compressor by adjusting the flow in the pressurizing passage thereby changing the pressure in the crank chamber and altering the inclination of a swash plate. The compressor further includes a bleeding passage. An oil separator is arranged in the bleeding passage to separate lubricating oil from the refrigerant gas flowing through the bleeding passage. The oil separator and the crank chamber are connected to each other by a recovery passage, through which the separated lubricating oil is returned to the crank chamber, and a pressurizing passage. A venturi tube is employed to help transfer oil from the oil separator to the crank chamber.

20 Claims, 5 Drawing Sheets

COMPRESSOR

BACKGROUND OF THE INVENTION

The present invention relates to compressors that are employed in automotive air-conditioning systems.

Variable displacement compressors are often used in automotive air-conditioning systems. A typical variable displacement compressor has a crank chamber, which is defined in a housing. A drive shaft is rotatably supported in the crank chamber. The housing includes a cylinder block through which cylinder bores extend. A piston is accommodated in each cylinder bore. A cam plate is fitted to the drive shaft and arranged in the crank chamber. The cam plate is supported such that it can be inclined while rotating integrally with the drive shaft. Each piston is coupled to the cam plate such that the rotation of the drive shaft reciprocates the piston and compresses refrigerant gas. The compressed gas is then sent into a discharge pressure zone, which is defined in the compressor housing. Afterward, the gas is discharged from the compressor to circulate through an external refrigerant circuit. The gas then returns to the compressor and enters a suction pressure zone, which is also defined in the compressor housing. Lubricating oil is suspended in the refrigerant gas. Thus, the refrigerant gas functions to lubricate moving parts. The displacement of the compressor is controlled by adjusting the amount of refrigerant gas drawn into the crank chamber.

The discharge pressure zone and the crank chamber are connected to each other by a pressurizing passage. The crank chamber and the suction pressure zone are connected to each other by a bleeding passage. A displacement control valve is arranged in the pressurizing passage. The displacement control valve adjusts the opening size of the pressurizing passage to restrict the amount of refrigerant gas passing therethrough in accordance with the pressure of the suction pressure zone. This controls the amount of refrigerant gas that is sent from the discharge pressure zone to the crank chamber and alters the pressure of the crank chamber. The difference between the pressure in the crank chamber, which is applied to one side of the pistons, and the pressure in the cylinder bores, which is applied to the other side of the pistons, causes the cam plate to incline with respect to the drive shaft. This changes the stroke of each piston and varies the compressor displacement.

The moving parts in the crank chamber are lubricated by lubricating oil residing in the crank chamber. Refrigerant gas leaks between each cylinder bore and the associated piston and enters the crank chamber. The gas leakage, or blowby gas, contains a large amount of lubricating oil. Thus, the amount of lubricating oil residing in the crank chamber depends on the amount of blowby gas. When the compressor is operated with a high displacement, the compression ratio of the refrigerant gas increases. This, in turn, increases the amount of blowby gas. Accordingly, the crank chamber is supplied with a sufficient amount of lubricating oil.

However, when the compressor is operated with a low displacement, the compression ratio of the refrigerant gas decreases. This, in turn, decreases the amount of blowby gas. In addition, the lubricating oil residing in the crank chamber is agitated and thus atomized by rotating parts such as the cam plate. The atomized oil is mixed with the refrigerant gas and forced toward the suction pressure zone through the bleeding passage. Therefore, the amount of lubricating oil with which the crank chamber is supplied may become insufficient, especially, when the compressor is of a variable displacement type that increases the pressure of the compressor by sending refrigerant gas into the crank chamber from the discharge pressure zone. Accordingly, the decreased amount of lubricating oil in the crank chamber may result in insufficient lubrication of the moving parts.

In a fixed displacement type compressor, the refrigerant gas that returns to the compressor from the external refrigerant circuit typically flows through the crank chamber before entering the suction chamber. Thus, the lubricating oil in the crank chamber has a tendency to escape into the suction chamber. Accordingly, the crank chamber must constantly be replenished with lubricating oil.

SUMMARY OF THE INVENTION

Accordingly, it is an objective of the present invention to provide a compressor that maintains the amount of lubricating oil in the crank chamber at a sufficient level.

To achieve the above objective, the present invention provides a compressor including a crank chamber for containing gas mixed with atomized lubricating oil and a compressing mechanism for drawing and compressing the gas. The compressor further includes a suction zone from which the compressing mechanism draws gas and in which the pressure of the drawn in gas acts, and a discharge zone to which the mechanism delivers gas and in which the pressure of the discharged gas acts. A bleeding passage connects the crank chamber to the suction zone to allow gas to flow from the crank chamber to the suction zone. An oil separator chamber is provided in the bleeding passage to separate atomized oil from the gas. An oil recovery passage connects the oil separator chamber to the crank chamber to return the separated lubricating oil to the crank chamber.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a variable displacement compressor according to the present invention will now be described.

The compressor is incorporated in automotive air-conditioning systems.

Figure 1:
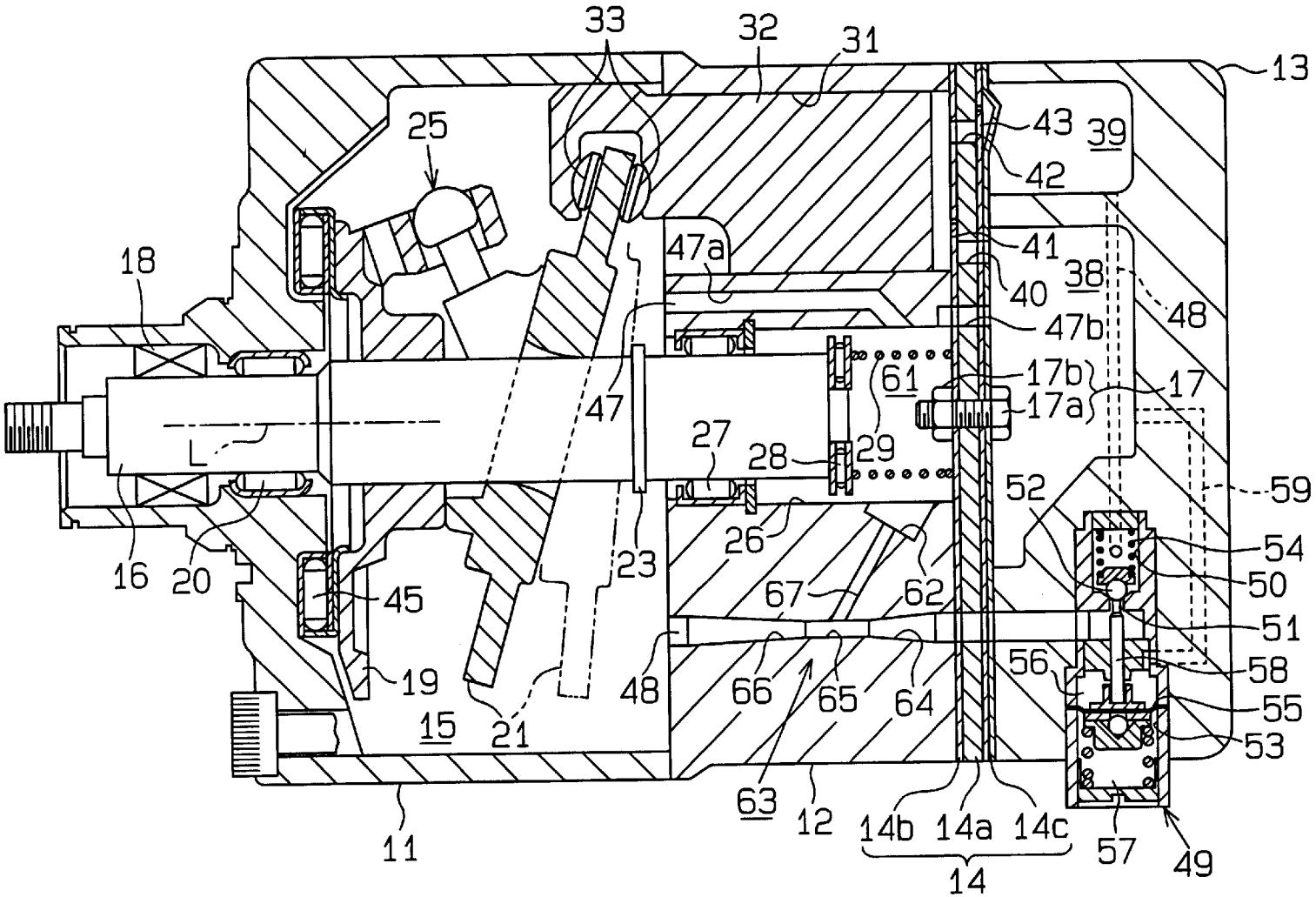
FIG. 1 is a cross-sectional view showing of a variable displacement compressor according to a first embodiment the present invention.

As shown in FIG. 1, a front housing 11 is coupled to the front end of a center housing, or cylinder block 12. A rear housing 13 is coupled to the rear end of the cylinder block 12 with a valve mechanism 14 arranged therebetween. The valve mechanism 14 includes a port plate 14*a*, in which suction ports 40 and discharge ports 42 are defined, a suction valve plate 14*b*, in which suction flaps 41 are defined, and a discharge valve plate 14*c*, in which discharge flaps 43 are defined. A fastener 17, which includes a bolt 17*a* and a nut 17*b*, extends through the center of the valve mechanism 14 and fastens the plates 14*a*, 14*b*, 14*c* to one another. A crank chamber 15 is defined in the front housing 11 in front of the cylinder block 12.

A rotatable drive shaft 16 extends through the crank chamber 15 between the front housing 11 and the cylinder block 12. The drive shaft 16 has a front end, which is supported by the front housing 11 by way of a front radial bearing 20. A shaft bore 26 extends through the center of the cylinder block 12. The rear end of the drive shaft 16 is inserted into the shaft bore 26 and supported by the inner wall of the shaft bore 26 by way of a rear radial bearing 27. The space between the wall of the shaft bore 26 and the drive shaft 16 is sealed by the rear radial bearing 27. Thus, the shaft bore 26 is substantially disconnected from the crank chamber 15. The other side of the shaft bore 26 is sealed by the valve mechanism 14. A thrust bearing 28 and a spring 29 are arranged between the rear end face of the drive shaft 16 and the valve mechanism 14. The spring 29 urges the drive shaft 16 toward the front housing 11. The thrust bearing 28 prevents the torque of the drive shaft 16 from being transmitted to the spring 29.

The drive shaft 16 is connected to an external power source, or engine (not shown), by way of a clutch mechanism, which includes an electromagnetic clutch. Accordingly, the electromagnetic clutch connects the drive shaft 16 to rotate the drive shaft 16 with the power of the engine.

A lip seal 18 seals the space between the front end of the drive shaft 16 and the front housing 11. A rotor 19 is fixed to the drive shaft 16 in the crank chamber 15. A cam plate, or swash plate 21, is arranged in the crank chamber 15. A hinge mechanism 25 connects the swash plate 21 to the rotor 19. The hinge mechanism 25 rotates the swash plate 21 integrally with the rotor 19 and supports the swash plate 21 such that it inclines with respect to and slides along the axis of the drive shaft 16 while rotating integrally with the rotor 19. When the central portion of the swash plate 21 moves toward the cylinder block 12, the inclination of the swash plate 21 decreases. A ring 23 is fixed to the drive shaft 16 between the swash plate 21 and the cylinder block 12 to restrict the axial movement of the swash plate 21. As the inclination of the swash plate 21 decreases, the swash plate 21 abuts against the ring 23. In this state, the swash plate 21 is located at a minimum inclination position. When the inclination of the swash plate 21 increases, the swash plate 21 abuts against the rotor 19. In this state, the swash plate 21 is located at a maximum inclination position.

Parallel cylinder bores 31 (only one shown in FIG. 1), which are equally spaced from each other, extend through the cylinder block 12 about the drive shaft axis L. A single-headed piston 32 is accommodated in each cylinder bore 31. Each piston 32 is coupled to the peripheral portion of the swash plate 21 by means of shoes 33. This structure converts the rotation of the swash plate 21 to linear reciprocation of the piston 32.

A suction pressure zone, or suction chamber 38, is defined in the central portion of the rear housing 13. The suction chamber 38 is adjacent to the shaft bore 26 and is located on the opposite side of the valve mechanism 14 from the shaft bore 26. The bolt 17*a* of the fastener 17 is inserted through the valve mechanism 14 and fastened to the nut 17*b* in the shaft bore 26. The fastener 17 is coaxial with the drive shaft 16. A discharge pressure zone, or discharge chamber 39, is defined in the peripheral portion of the rear housing 13. Each cylinder bore 31 is provided with a suction port 40, a suction flap 41, a discharge port 42, and a discharge flap 43, which are formed in the valve mechanism 14. The suction chamber 38 is supplied with refrigerant gas. When each piston 32 moves from its top dead center position to its bottom dead center position, the refrigerant gas in the suction chamber 38 is drawn through the associated suction port 40 to open the suction flap 41 and enter the associated cylinder bore 31. When the piston 32 moves from the bottom dead center position to the top dead center position, the refrigerant gas in the cylinder bore 31 is first compressed. The compressed gas is then discharged into the discharge chamber 39 through the associated discharge port 42 as the gas opens the associated discharge flap 43.

A thrust bearing 45 is arranged between the rotor 19 and the inner wall of the front housing 11. The thrust bearing 45 receives the compression load, which is produced during compression of the refrigerant gas and acts on the rotor 19.

A bleeding passage 47 connects the crank chamber 15 to the suction chamber 15. A pressurizing passage 48 connects the discharge chamber 39 to the crank chamber 15. A displacement control valve 49 is arranged in the pressurizing passage 48. The control valve 49 has a valve port 51, which is connected with a valve chamber 50. The valve port 51 and the valve chamber 50 form part of the pressurizing passage 48. A valve body 52 is retained in the valve chamber 50 and supported such that it can move toward and away from the valve port 51. A spring 54 is arranged in the valve chamber 50 to urge the valve body 52 toward the port 51. The control valve 49 further includes a diaphragm compartment 53. A diaphragm 55 is arranged in the diaphragm compartment 53 to partition an internal pressure chamber 56 from an external pressure chamber 57, which is exposed to atmospheric pressure. A rod 58 connects the valve body 52 to the diaphragm 55. An internal pressure passage 59 connects the suction chamber 38 to the internal pressure chamber 56. Thus, the suction chamber 38 is connected with the internal pressure chamber 56 through the internal pressure passage 59.

The diaphragm 55 deforms in accordance with the pressure in the suction chamber 38 and adjusts the opening size of the valve port 51, or the opening size of the pressurizing passage 48. This alters the pressure of the crank chamber 15 and adjusts the difference between the pressure of the crank chamber 15, which acts on one side of the pistons 32, and the pressure of the cylinder bores 32, which acts on the other side of the pistons 32. The inclination of the swash plate 21 varies in accordance with the pressure difference and thus changes the stroke of the pistons 32. This, in turn, varies the volume of refrigerant gas that is discharged into an external refrigerant circuit (not shown) from the discharge chamber 39.

If the cooling load increases, the pressure in the suction chamber 38 increases. When the suction chamber pressure exceeds a predetermined value, the control valve 49 decreases the opening size of the pressurizing passage 48, as shown in FIG. 1. As a result, the pressure of the crank chamber 15 is released into the suction chamber 38 through the bleeding passage 47. This moves the swash plate 21 toward the maximum inclination position and lengthens the stroke of the pistons 32. Consequently, the displacement increases and the suction chamber pressure decreases to a value that is close to the predetermined value.

Figure 2:
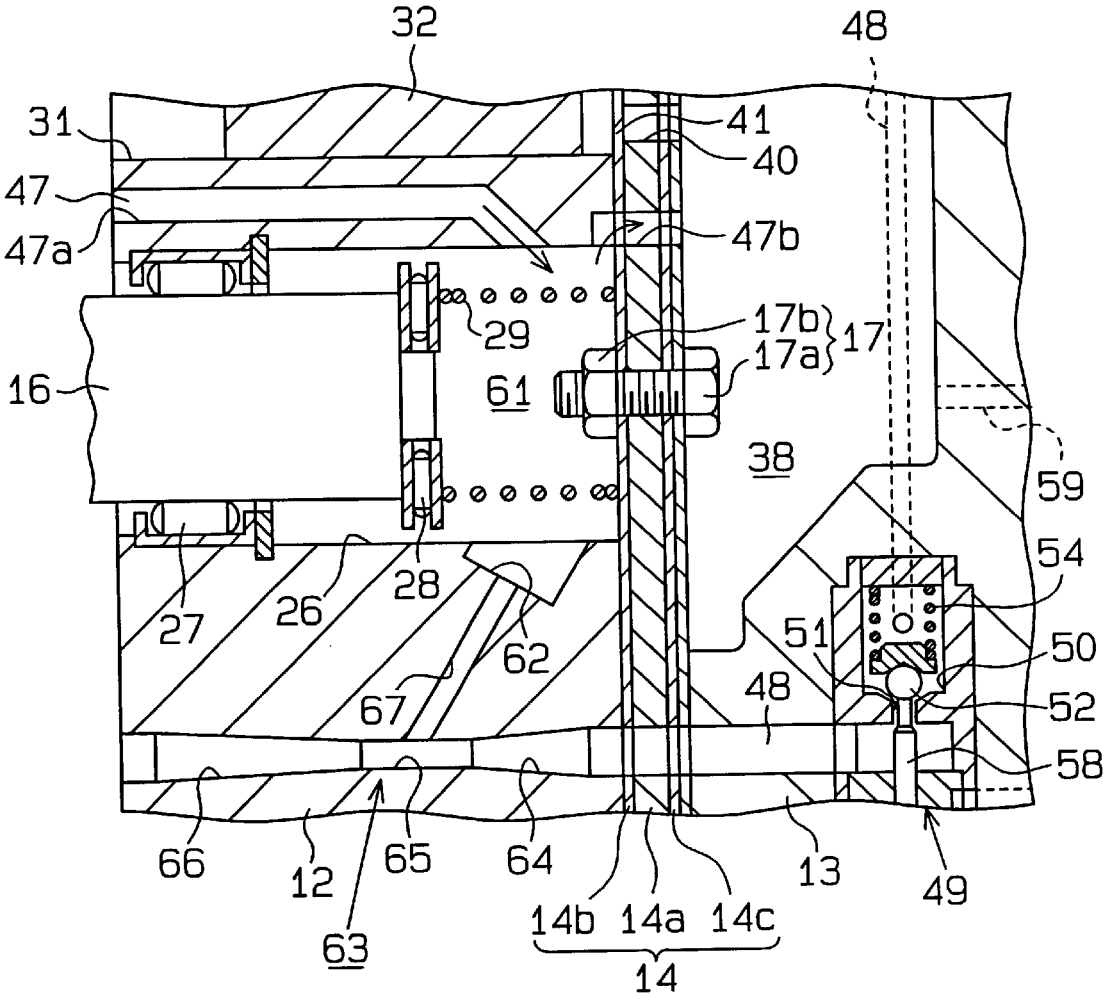
FIG. 2 is an enlarged cross-sectional view showing the compressor of FIG. 1.

If the cooling load decreases, the pressure in the suction chamber 38 decreases. When the suction chamber pressure falls below a predetermined value, the control valve 49 increases the opening size of the pressurizing passage 48, as shown in FIG. 2. As a result, the refrigerant gas in the discharge chamber 39 increases the pressure of the crank chamber 15. This moves the swash plate 21 toward the minimum inclination position and shortens the stroke of the pistons 32. Consequently, the displacement decreases and the suction chamber pressure increases to a value that is close to the predetermined value.

As shown in FIG. 2, an oil separator 61 is arranged in the bleeding passage 47. The oil separator 61 uses part of the shaft bore 26 located near the valve mechanism 14. The bleeding passage 47 includes an inlet 47*a* and an outlet 47*b*. The inlet 47*a* extends through the cylinder block 12 and connects the crank chamber 15 to the oil separator 61. The outlet 47*b* extends through the valve mechanism 14 and connects the oil separator 61 to the suction chamber 38. Furthermore, the outlet 47*b* is more narrow than the inlet 47*a* and functions as a throttle. The oil separator 61 has a lower wall in which an oil sink 62 is formed.

The lubricating oil in the crank chamber 15 is agitated and atomized by rotating parts, such as the swash plate 21 and the rotor 19. This mixes the lubricating oil with the refrigerant gas flowing toward the suction chamber 38 through the bleeding passage 47. However, when the refrigerant gas enters the oil separator 61, the gas is blown against the wall of the oil separator, the valve mechanism 14, the thrust bearing 28, the spring 29, the fastener 17, and other parts. As a result, inertial forces and the difference in specific gravity separate the lubricating oil from the refrigerant gas. A large portion of the separated lubricating oil falls and collects in the oil sink 62. The refrigerant gas, from which lubricating oil has been separated, is sent toward the suction chamber 38 through the outlet 47*b*.

The portion of the pressurizing passage 48 between the control valve 49 and the crank chamber 15 is located below the oil separator 61. A venturi tube 63 is defined in this portion. The venturi tube 63, which serves as a depressurizing zone, has a tapered portion 64, the diameter of which decreases gradually toward the crank chamber 15, a throat 65, the diameter of which is the smallest in the venturi tube 63, and a diffuser 66, the diameter of which increases gradually toward the crank chamber 15. The throat 65 is connected to the oil sink 62 by a recovery passage 67. Accordingly, the portion of the pressurizing passage 48 between the throat 65 and the crank chamber 15 serves as an oil recirculation passage.

When the swash plate 21 is moved toward the maximum inclination position to increase displacement, the stroke of the pistons 32 increases and thus raises the compression ratio of the refrigerant gas. This increases the amount of blowby gas that leaks through each cylinder bore 31 and the associated piston 32. A large amount of lubricating oil applied to the wall of the cylinder bore 31 is sent into the crank chamber 15 together with blowby gas. Thus, a large amount of lubricating oil resides in the crank chamber 15. As a result, the moving parts in the crank chamber 15, such as the bearings 20, 27, 45, the swash plate 21, and the shoes 33 are sufficiently lubricated.

The refrigerant gas in the discharge chamber 39 is sent to the crank chamber 15 to increase the pressure of the crank chamber 15 and decrease the displacement. The lubricating oil in the crank chamber then mixes with the refrigerant gas as the gas further flows toward the suction chamber 38 through the bleeding passage 47. This decreases the amount of the lubricating oil in the crank chamber 15. However, when the refrigerant gas passes through the venturi pipe 63, the tapered portion 64 converts pressure energy to velocity energy, while the diffuser converts velocity energy to pressure energy. Thus, as the high-pressure, low-speed gas from the discharge chamber 39 flows into the tapered portion 64, the tapered portion 64 converts the gas to a low-pressure, high-speed gas when flowing into the throat 65. The gas then flows into the diffuser 66 and is returned to a low-speed, high-pressure state before entering the crank chamber 15.

Accordingly, the pressure in the throat 65 is lower than that in the crank chamber 15. The pressure in the oil separator 61 is about the same as that in the crank chamber 15. Thus, there is a difference between the pressure in the throat 65 and the pressure in the crank chamber 15. The pressure difference causes the lubricating oil collected in the oil separator 61 to be drawn into the throat 65. The lubricating oil is then returned to the crank chamber 15 by the refrigerant gas flowing through the throat 65. In this manner, lubricating oil is separated from the refrigerant gas flowing toward the suction chamber 38 from the crank chamber 15 and returned to the crank chamber 15 by the refrigerant gas flowing through the pressurizing passage 48. This maintains a sufficient amount of lubricating oil in the crank chamber 15.

The pressure of the throat 65 is kept below that of the oil separator 61 by the diffuser 66. In other words, the high-speed, low-pressure gas in the throat 65 is converted to a low-speed, high-pressure state in the diffuser 66 to keep the pressure of the crank chamber 15 higher than that of the upstream throat 65. Furthermore, the diameter of the inlet 47*a* of the bleeding passage 47 is large enough to keep the pressure in the oil separator 61 about the same as that of the pressure in the crank chamber 15. The throttling effect of the outlet passage 47*b*, which is located in the suction chamber side of the oil separator 61, produces a difference between the pressure in the crank chamber 15 and the pressure in the suction chamber 38.

As described above, the lubricating oil separated from the refrigerant gas by the oil separator 61, which is included in the bleeding passage 47, is returned to the crank chamber 15 by the venturi pipe 63, which forms a low pressure zone in the pressurizing passage 48. Thus, a sufficient amount of lubricating oil is maintained in the crank chamber 15 even if the displacement is minimized. As a result, a large amount of lubricating oil resides in the crank chamber, even when the compressor commences operation after having stopped operation in a minimum displacement state. This sufficiently lubricates the moving parts.

The advantages of the first embodiment will now be described.

(1) The moving parts are sufficiently lubricated regardless of whether the compressor displacement is small or whether operation of the compressor has just commenced. This enhances the durability of the compressor.

(2) The venturi tube 63 is arranged in the pressurizing passage 48 with its throat 65 connected to the oil separator 61 by the recovering passage 67. Thus, the lubricating oil separated from the refrigerant gas by the oil separator 61 is positively returned to the crank chamber 15 to maintain a large amount of lubricating oil in the crank chamber 15.

(3) The venturi tube 63 has a simple structure and is formed merely by varying the diameter of the pressurizing passage 48. Thus, the low pressure zone is easily formed.

(4) The venturi tube 63 includes a tapered portion 64, which is formed by gradually decreasing the diameter of the pressurizing passage 48 toward the throat 65 from the control valve side. This efficiently converts the pressure energy of the refrigerant gas to velocity energy. As a result, the venturi tube 63 decreases the pressure loss of the refrigerant gas. Thus, for example, the pressure of the crank chamber 15 may be sufficiently increased even if the pressure in the discharge chamber 39 is low. This prevents delays in the response of the compressor when controlling the displacement.

(5) The venturi pipe 63 is located below the oil separator 61. Thus, when the control valve 48 closes the pressurizing passage 48 and impedes the flow of refrigerant gas, a small amount of the separated lubricating oil still falls into the throat 65. The lubricating oil collected in the throat 65 further moves into the crank chamber 15.

(6) The oil separator 61 is formed in the shaft bore 26, which retains the rear end of the drive shaft 16 in the cylinder block 12. Therefore, a separate space for the oil separator 61 is not necessary in the compressor housing. Space in the compressor housing, which includes the front housing 11, the cylinder block 12, and the rear housing 13, is used by the crank chamber 15, the cylinder bores 31, the suction chamber 38, the discharge chamber 39, and other parts. Thus, the sharing of the shaft bore 26 by the oil separator 61 not only saves space but also keeps the compressor compact.

A second embodiment according to the present invention will now be described. To avoid a redundant description, like or same reference numerals are given to those components that are the same as the corresponding components of the first embodiment.

Figure 3:
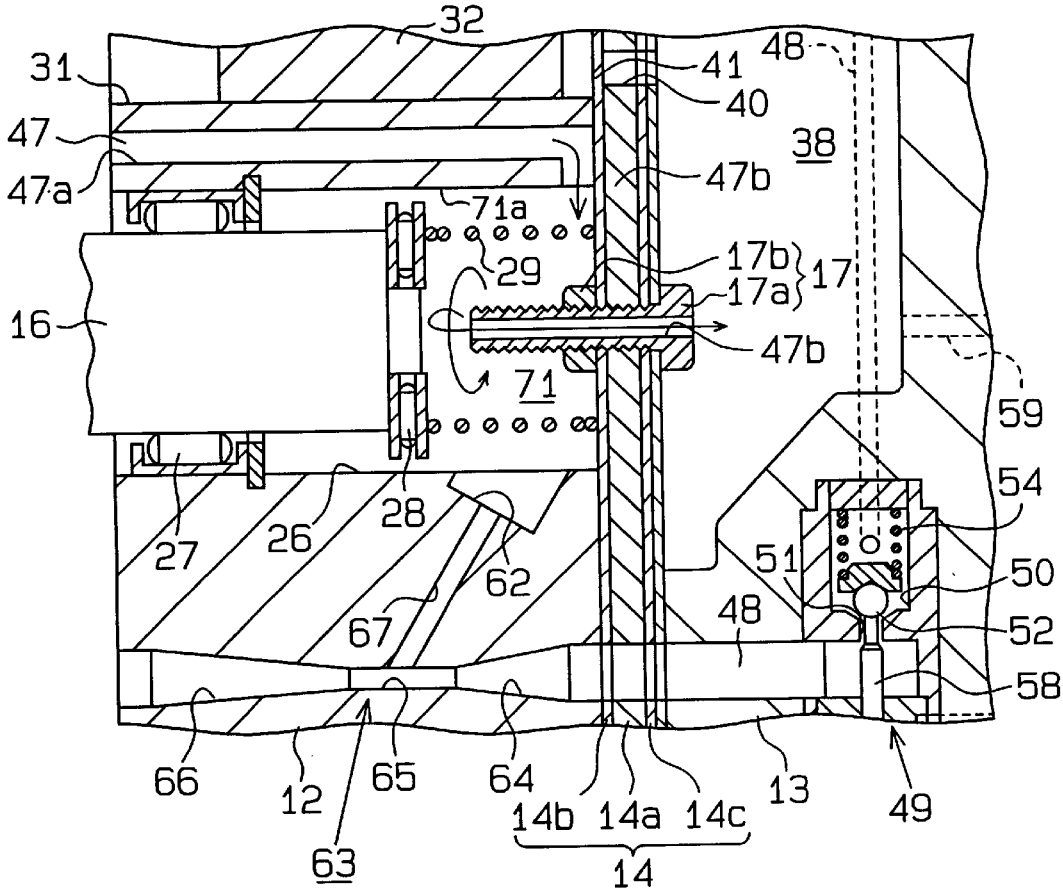
FIG. 3 is a cross-sectional view partially showing a variable displacement compressor according to a second embodiment of the present invention.
Figure 4:
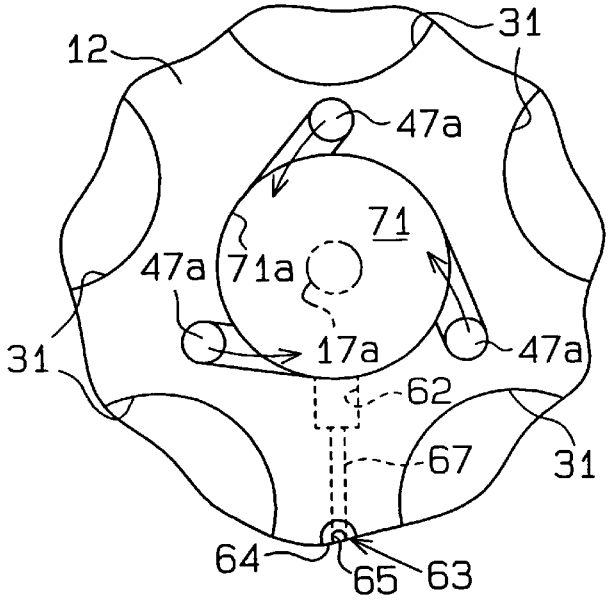
FIG. 4 is a partial, enlarged rear view showing a cylinder block of the compressor of FIG. 3.

As shown in FIGS. 3 and 4, the compressor of this embodiment employs an oil separator 71, which serves as a centrifugal separator. The oil separator 71 has a plurality of inlets 47*a* (three in this embodiment) extending toward the shaft bore 26. Part of the oil separator 71 is formed by the cylindrical wall of the shaft bore 26. The cylindrical wall defines a separating surface 71*a*, which is used to separate lubricating oil from the refrigerant gas. More specifically, refrigerant gas containing lubricating oil enters the oil separator 71 through the inlets 47*a* and rotates along the separating surface 71*a*. This results in centrifugation of the refrigerant gas and separates the lubricating oil from the gas. Furthermore, the refrigerant gas enters the oil separator 71 along the separating surface 71*a* in tangential directions, as shown in FIG. 4. This produces a smooth stream of the refrigerant gas along the separating surface 71 in the oil separator 71 and enhances the centrifugation effect.

In the second embodiment, the bolt 17*a*, which is located at the center of the cylindrical separating surface 71*a*, defines a separating tube. Further, the bolt 17*a* is longer than the bolt 17*a* of the first embodiment and thus extends farther into the oil separator 71. The oil separator 71 has an outlet 47*b*, which is defined by a passage extending through the bolt 17*a* and which is connected to the suction chamber 38. Centrifugal force, which is produced by the rotating stream of the refrigerant gas in the oil separator 71, forces the lubricating oil outward. Thus, the amount of lubricating oil is smaller at positions closer to the center of the oil separator 71. Consequently, lubricating oil is substantially removed from the refrigerant gas that enters the separating tube and flows toward the suction pressure zone. This structure enhances the efficiency for recovering lubricating oil in the oil separator 71.

The second embodiment has the advantages described below.

(1) The oil separator 71 functions as a centrifugal separator. Thus, refrigerant gas and lubricating oil are effectively separated from each other by centrifugation force.

(2) The inlets 47*a* are tangential with respect to the separating surface 71*a*. Accordingly, the refrigerant gas that flows into the oil separator 71 from the crank chamber 15 is directed along the separating surface 71*a*, which improves the centrifugation effect.

(3) The rotating stream of the refrigerant gas causes centrifugation and decreases the amount of lubricating oil at positions located closer to the center of the oil separator 71. Accordingly, lubricating oil is substantially removed from the refrigerant gas that enters the separating tube and flows toward the suction chamber 38. This improves the efficiency of recovering lubricating oil in the oil separator 71.

(4) The bolt 17*a*, which fastens the plates 14*a*, 14, 14*c* of the valve mechanism 14, is employed as the separating tube. This decreases the number of components and simplifies the structure of the oil separator 71.

A third embodiment according to the present invention will now be described. In this embodiment, the present invention is applied to a fixed displacement type compressor that employs double-headed pistons. To avoid a redundant description, like or same reference numerals are given to those components that are the same as the corresponding components of the first and second embodiments. The description centers on parts differing from the first and second embodiments.

Figure 5:
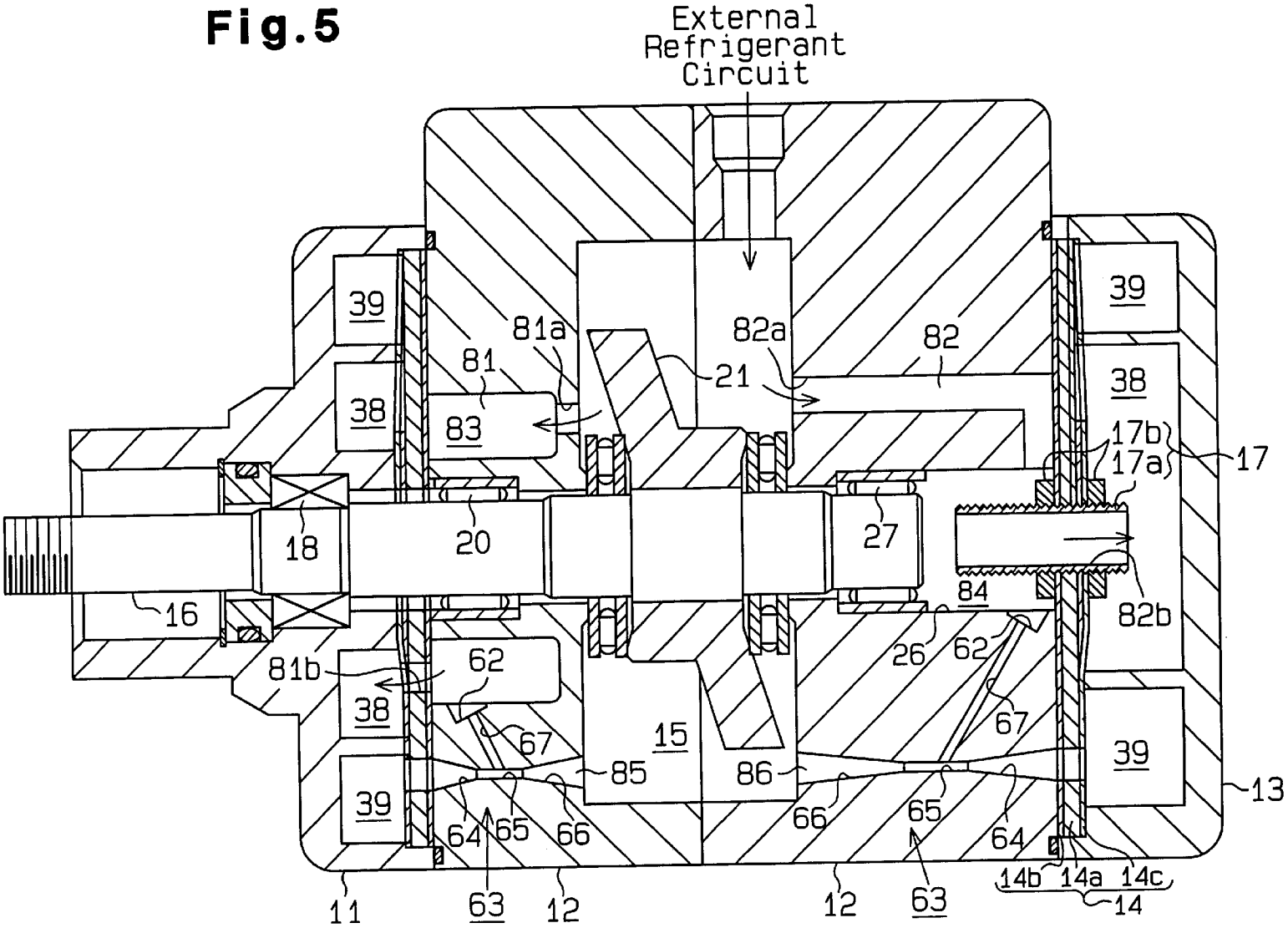
FIG. 5 is a cross-sectional view showing a third embodiment of a variable displacement compressor according to the present invention.
Figure 6:
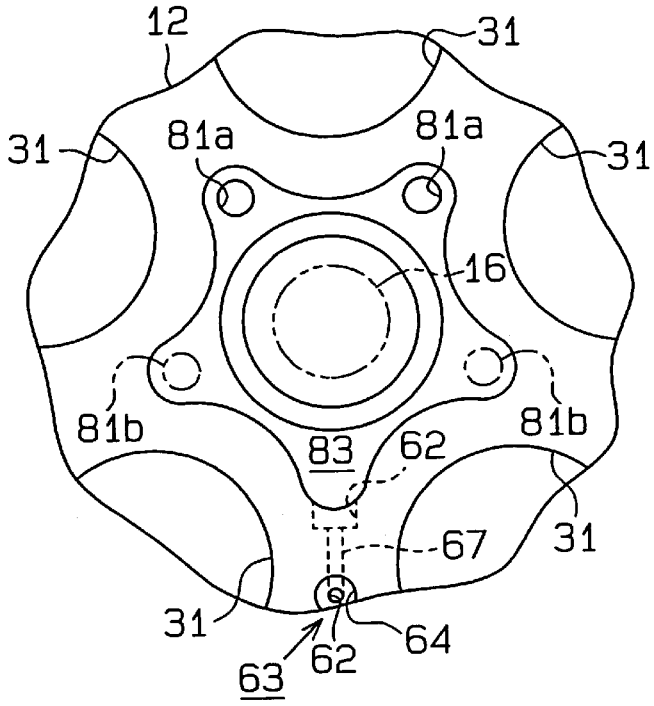
FIG. 6 is a partial, enlarged front view showing a front cylinder block of the compressor of FIG. 5.
Figure 7:
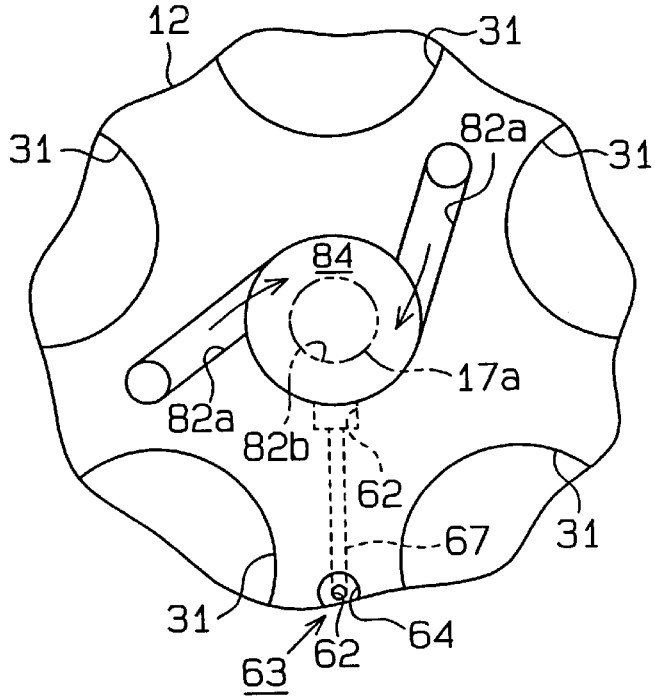
FIG. 7 is an enlarged rear view showing a rear cylinder block of the compressor of FIG. 5.

As shown in FIGS. 5 to 7, a swash plate 21 is fixed to a drive shaft 16. The rotation of the swash plate 21 reciprocates double-headed pistons (not shown). The compressor includes a front housing 11, a pair of cylinder blocks 12, and a rear housing 13. Each piston is accommodated in a pair of cylinder bores 31, one of which extends through the front housing 11 and the other of which is defined in the rear housing 13. A suction chamber 38 and a discharge chamber 39 is defined in the front housing 11 and in the rear housing 13. The reciprocation of the pistons draws refrigerant gas into each pair of cylinder bores 31 from the associated suction chamber 38, compresses the gas, and then discharges the gas into the associated discharge chamber 39. A crank chamber 15, which is housed in the front and rear cylinder blocks 12, is connected with an external refrigerant circuit. A suction passage 81 extends through the front cylinder block 12 to connect the crank chamber 15 to the front suction chamber 38, while a further suction passage 82 extends through the rear cylinder block 12 to connect the crank chamber 15 to the rear suction chamber 15. The suction passages 81, 82 define a bleeding passage for supplying the suction chambers 38 with the refrigerant gas drawn in from an external refrigerant circuit.

A front oil separator 83 is defined in the front suction passage 81, while a rear oil separator 84 is defined in the rear suction passage 82. The rear oil separator 84 has a structure similar to that of the second embodiment and functions in the same manner. The rear suction passage 82 has an outlet 82*b*, which extends through the bolt 17*a* and also functions as the outlet of the rear oil separator 84. The cross-sectional area of the outlet 82*b* is greater than that of the oil separator outlet 47*b* of the second embodiment. Thus, the outlet 82*b* does not function as a throttle. The front discharge chamber 39 is connected to the crank chamber 15 by a front pressurizing passage 85, while the rear discharge chamber 39 is connected to the crank chamber 15 by a rear pressurizing passage 86. A venturi tube 63 is formed in each pressurizing passage 85, 86. Each venturi tube 63 has a throat 65, which is connected to the associated oil separator 83, 84 through front and rear recovery passages 67.

The front suction passage 81 has an inlet 81*a* through which the refrigerant gas in the crank chamber 15 is drawn in toward the front oil separator 83. The rear suction passage 82 also has an inlet 82*a* through which the refrigerant gas in the crank chamber 15 is drawn toward the rear oil separator 84. Lubricating oil is separated from the refrigerant gas that flows into the front oil separator 83 by inertial force and specific gravity as in the oil separator of the first embodiment. The associated venturi tube 63 returns the separated lubricating oil to the crank chamber 15 through the front recovery passage 67 and the front pressurizing passage 85 together with refrigerant gas. The refrigerant gas from which lubricating oil has been removed flows into the front suction chamber 38 from the front oil separator 83 through an outlet 81*b* of the suction passage 81. The outlet 81*b* also serves as the outlet of the front oil separator 81.

Lubricating oil is separated from the refrigerant gas that flows into the rear oil separator 84 by centrifugation in the same manner as described with regard to the second embodiment. The rear venturi tube 63 returns the separated lubricating oil to the crank chamber 15 through the rear recovery passage 67 and the pressurizing passage 86 together with refrigerant gas. The refrigerant gas from which lubricating oil has been removed flows into the rear suction chamber 38 from the rear oil separator 84 through the outlet 82*b*.

The swash plate 21 agitates the lubricating oil, which is returned to the crank chamber 15. This lubricates the bearings 20, 27, the seal 18, and other components.

Accordingly, the third embodiment has the same advantages that result from the compressors of the first and second embodiments.

It should be apparent to those skilled in the art that the present invention may be embodied in many other specific forms without departing from the spirit or scope of the invention. More specifically, the present invention may be embodied as described below.

In the first and second embodiments, a separate exclusive space for the oil separators 61, 71 may be provided in the compressor housing.

In each of the preferred embodiments, a jet pump may be arranged in the pressurizing passages 48, 85, 86 in lieu of the venturi tube. In this case, the jet pump forces the separated lubricating oil toward the pressurizing passages 48, 85, 86 from the oil separators 61, 71, 83, 84.

In each of the preferred embodiments, the tapered portion 64 may be eliminated from the venturi tube 63.

In the first and second embodiments, the present invention is applied to a variable displacement compressor that adjusts the amount of refrigerant gas drawn into the crank chamber 15. However, the application of the present invention is not limited to such compressor. For example, the present invention may be applied to a compressor that controls the amount of refrigerant gas sent out of the crank chamber 15 in addition to the amount of refrigerant gas drawn into the crank chamber 15 by employing a three-way switch valve, or the like.

In the third embodiment, a so-called wave cam plate may be employed in lieu of the swash plate 21.

The present invention may be applied to a wobble type variable displacement compressor, which employs a wobble plate in lieu of the swash plate 21. The present invention may also be applied to a fixed displacement type compressor that employs single-headed pistons.

Therefore, the present examples and embodiments are to be considered as illustrative and not restrictive, and the invention is not to be limited to the details given herein, but may be modified within the scope and equivalence of the appended claims.

What is claimed is:

1. A compressor comprising:

crank chamber for containing gas mixed with atomized lubricating oil;

a compressing mechanism for drawing and compressing the gas;

a suction zone from which the compressing mechanism draws gas and in which the pressure of the drawn in gas acts;

a discharge zone to which the mechanism delivers gas and in which the pressure of the discharged gas acts;

a bleeding passage connecting the crank chamber to the suction zone to allow gas to flow from the crank chamber to the suction zone;

an oil separator chamber provided within and forming a part of the bleeding passage to separate atomized oil from the gas flowing from the crank chamber through the bleeding passage to the suction zone; and an oil recovery passage connecting the oil separator chamber to the crank chamber to return the separated lubricating oil to the crank chamber.

2. A compressor as recited in claim 1, further comprising:

a pressurizing passage connecting the discharge zone to the crank chamber to allow gas to flow from the discharge zone to the crank chamber, wherein the oil recovery passage joins the pressurizing passage, so that a downstream portion of the pressurizing passage forms a downstream portion of the oil recovery passage.

3. A compressor as recited in claim 1, further comprising:

a pressurizing passage connecting the discharge zone to the crank chamber to allow gas to flow from the discharge zone to the crank chamber; and a low-pressure zone located in the pressurizing passage, wherein the low-pressure zone has a pressure lower than that of the oil separator chamber, wherein the low-pressure zone is connected to the oil recovery passage, so that a downstream portion of the pressurizing passage forms a portion of the oil recovery passage.

4. A compressor as recited in claim 3, wherein the low-pressure zone is formed by a venturi tube.

5. A compressor as recited in claim 1, wherein an upstream portion of the bleeding passage connects the crank chamber and the oil separator chamber, and a downstream portion of the bleeding passage connects the oil separator chamber and the suction zone, and the upstream portion is large enough that the gas pressure in the oil separator chamber is substantially the same as that in the crank chamber.

6. A compressor as recited in claim 1, wherein the oil separator chamber is cylindrical, and the inner surface of the oil separator chamber forms a separating surface for centrifugally separating the lubricating oil from the gas.

7. A compressor as recited in claim 6, wherein the bleeding passage is tangentially connected to the oil separator chamber such that the gas flows into the oil separator chamber from a direction generally tangential to the separating surface.

8. A compressor as recited in claim 7, wherein a separating tube is located generally in the center of the separating surface, and wherein the separating tube forms a part of the bleeding passage.

9. A compressor as recited in claim 1, wherein the compressing mechanism comprises:

a drive shaft located in the crank chamber, wherein one end of the drive shaft is rotatably supported in a shaft bore adjoining the suction zone;

a cam plate located in the crank chamber to rotate in conjunction with the drive shaft; and a piston housed in a cylinder bore to be reciprocated by the rotation of the cam plate, wherein gas is drawn into the cylinder bore from the suction zone, is compressed and thereafter is discharged to the discharge zone by the piston.

10. A compressor as recited in claim 9, further comprising a control valve for adjusting the pressure in the crank chamber, wherein the cam plate is a swash plate, the angle of which changes relative to the axis of the drive shaft depending on the pressure in the crank chamber, wherein the angle of the swash plate determines the displacement of the compressor.

11. A compressor as recited in claim 9, wherein a portion of the shaft bore serves as the oil separator chamber.

12. A compressor for compressing refrigerant gas mixed with lubricating oil, the compressor comprising:

a housing, a crank chamber located within the housing, wherein the crank chamber contains refrigerant gas mixed with lubricating oil when the compressor is operating;

a suction chamber located within the housing;

a discharge chamber located within the housing;

a cylinder bore located within the housing;

a shaft bore at a central location within the housing;

a drive shaft located in the crank chamber, where one end of the drive shaft is rotatably supported in the shaft bore;

a cam plate located in the crank chamber, wherein the cam plate is connected to the drive shaft to rotate in conjunction with the drive shaft;

a piston housed in the cylinder bore to reciprocate by following the cam plate, wherein the piston draws refrigerant gas into the cylinder bore from the suction chamber, compresses the refrigerant gas, and thereafter discharges the refrigerant gas to the discharge chamber;

a bleeding passage connecting the crank chamber to the suction chamber to allow refrigerant gas to flow from the crank chamber to the suction chamber;

an oil separator chamber provided within and forming a part of the bleeding passage to separate atomized oil from the refrigerant gas flowing from the crank chamber through the bleeding passage to the suction chamber; and an oil recovery passage connecting the oil separator chamber to the crank chamber to return the separated lubricating oil to the crank chamber.

13. A compressor as recited in claim 12, further comprising:

a pressurizing passage connecting the discharge chamber to the crank chamber to allow refrigerant gas to flow from the discharge chamber to the crank chamber; and a low-pressure chamber located in the pressurizing passage, wherein the low-pressure chamber has a pressure lower than that of the oil separator chamber, wherein the low- pressure chamber is connected to the oil recovery passage, so that a downstream portion of the pressurizing passage forms a portion of the oil recovery passage.

14. A compressor as recited in claim 13, wherein the low-pressure chamber is formed by a venturi tube.

15. A compressor as recited in claim 12, wherein an upstream portion of the bleeding passage connects the crank chamber and the oil separator chamber, and a downstream portion of the bleeding passage connects the oil separator chamber and the suction chamber, and the upstream portion is large enough that the gas pressure in the oil separator chamber is substantially the same as that in the crank chamber.

16. A compressor as recited in claim 12, wherein the shaft bore serves as the oil separating chamber, wherein refrigerant gas mixed with lubricating oil is directed toward the wall of the oil separating chamber, and some of the oil adheres to the wall, which removes the oil from the refrigerant gas.

17. A compressor as recited in claim 16, wherein the oil separator chamber is cylindrical, and the inner surface of the oil separator chamber forms a separating surface for centrifugally separating the lubricating oil from the refrigerant gas.

18. A compressor according to claim 17, wherein the bleeding passage tangentially intersects the oil separating chamber to cause mixed refrigerant gas and oil entering the oil separating chamber from the bleeding passage to flow in a circular manner, thus centrifugally separating the oil and refrigerant gas.

19. A compressor as recited in claim 17, wherein a separating tube is located in a central part of the oil separator chamber, and wherein the separating tube forms part of the bleeding passage and permits refrigerant gas to exit the oil separating chamber.

20. A compressor comprising:

a housing;

a crank chamber located in the housing, wherein the crank chamber contains refrigerant gas mixed with atomized lubricating oil while the compressor is operating;

a reciprocating piston mechanism for drawing and compressing the refrigerant gas, wherein at least a portion of the mechanism is located in the crank chamber;

a suction chamber from which the piston mechanism draws refrigerant gas;

a discharge chamber to which the mechanism delivers refrigerant gas;

a bleeding passage connecting the crank chamber to the suction chamber to allow refrigerant gas to flow from the crank chamber to the suction chamber;

an oil separator chamber provided within and forming a part of the bleeding passage to separate atomized oil from the refrigerant gas flowing from the crank chamber through the bleeding passage to the suction chamber.

a pressurizing passage connecting the discharge chamber with the crank chamber; and an oil recovery passage connecting the oil separator chamber to the crank chamber to return the separated lubricating oil to the crank chamber, wherein the oil recovery passage joins the pressurizing passage, so that a downstream portion of the pressurizing passage is shared by a downstream portion of the oil recovery passage.

* * * * *

UNITED STATES PATENT AND TRADEMARK OFFICE

CERTIFICATE OF CORRECTION

PATENT NO. : 6,206,648 B1
DATED : March 27, 2001
INVENTOR(S) : Kazuya Kimura et al.

It is certified that error appears in the above-identified patent and that said Letters Patent is hereby corrected as shown below:

Column 4,
Line 29, please delete "suction chamber 15" and insert therefor -- suction chamber 38 --

Column 10,
Line 13, please insert -- a -- in front of "crank";

Column 12.
Lines 55-56, please delete "chamber." and insert therefor -- chamber; --

Signed and Sealed this

Twentieth Day of August, 2002

*Attest:*

*Attesting Officer*

JAMES E. ROGAN
*Director of the United States Patent and Trademark Office*